US006588069B2

(12) United States Patent
Deriaz et al.

(10) Patent No.: US 6,588,069 B2
(45) Date of Patent: Jul. 8, 2003

(54) BRACELET CLASP

(75) Inventors: Jean-Marc Deriaz, Collonge-Bellerive (CH); Luigi Ferrario, Marin-Epagnier (CH); Daniel Moille, Yvoire (FR)

(73) Assignee: Rolex S.A., Geneva (CH)

( * ) Notice: Subject to any disclaimer, the term of this patent is extended or adjusted under 35 U.S.C. 154(b) by 0 days.

(21) Appl. No.: 10/016,213

(22) Filed: Oct. 22, 2001

(65) Prior Publication Data

US 2002/0078535 A1 Jun. 27, 2002

(30) Foreign Application Priority Data

Oct. 26, 2000 (EP) ..... 00810993

(51) Int. Cl.[7] ..... A44C 5/24

(52) U.S. Cl. ..... 24/265 WS; 24/68 J; 24/71 J; 24/71 R

(58) Field of Search ..... 24/265 WS, 71 J, 24/70 J, 68 J, 69 J, 71 R; 224/166, 175, 178

(56) References Cited

U.S. PATENT DOCUMENTS 4,424,611 A * 1/1984 Mori ..... 24/265 WS
4,928,359 A * 5/1990 Gagnebin ..... 24/71 J
5,485,659 A * 1/1996 Kashikie et al. ..... 24/71 J
6,023,816 A * 2/2000 Okada et al. ..... 24/71 J
6,119,315 A 9/2000 Gay
6,185,799 B1 * 2/2001 Gay ..... 24/68 J

FOREIGN PATENT DOCUMENTS

| | | | |
|---|---|---|---|
| EP | 0 865 742 | 9/1998 | |
| EP | 0914781 | * 5/1999 | ..... 24/265 WS |
| FR | 2 519 522 | 7/1983 | |
| FR | 2 754 435 | 4/1998 | |
| WO | WO 98 30123 | 7/1998 | |

* cited by examiner

*Primary Examiner*—Victor Sakran
(74) *Attorney, Agent, or Firm*—Sturm & Fix LLP

(57) ABSTRACT

A bracelet clasp having two branches (1, 2) which are articulated to one another by a respective first one of their ends in order to make it possible to fold a first one of these branches over and/or into the second of said branches, and to unfold it in order to place it substantially in the extension of this second branch, while their respective second ends are intended to be connected to two ends of a bracelet. These two branches (1, 2) include mutual attaching structures (4, 10) for holding them in the folded position. The second end of the first articulated branch (1) includes linking structure (9) having parallel axes of articulation, one for connecting these linking structures to this first articulated branch (1) and at least a second one for connecting these linking structures (9) firstly to one end of the bracelet and secondly to an actuating member (18) for exerting a force capable of separating said mutual attaching structures (4, 10).

12 Claims, 10 Drawing Sheets

BRACELET CLASP

CROSS REFERENCE TO RELATED APPLICATIONS

This application claims priority of European Patent Application No. 00810993.6 filed Oct. 26, 2000.

BACKGROUND OF THE INVENTION

The present invention relates to a bracelet clasp comprising two branches articulated to one another by a respective first one of their ends in order to make it possible to fold a first one of these branches over and/or into the second of said branches, and to unfold it in order to place it substantially in the extension of this second branch, while their respective second ends are intended to be connected to two ends of a bracelet, particularly a bracelet for a wrist watch, these two branches including mutual attaching means for holding them in the folded position.

PRIOR ART

This type of clasp is well known and exists in the form of a number of variants. In certain clasps, one end of the bracelet is connected to the branch of the clasp which is folded over or into the other branch by a cover the parallel lateral faces of which, which are on either side of the clasp in the closed position, include several pairs of transversely aligned and longitudinally spaced holes which are intended to receive the articulation pin at the end of the bracelet. These pairs of holes make it possible to adjust the length of the bracelet. In other clasps of this type, the end of the bracelet is articulated directly to the second end of this first branch so that, in the closed position, the bracelet hides the clasp.

In some bracelets of this type, the branches which are articulated to one another are made from stamped sheet metal and cover one another in the folded position. These branches are curved in order to match the shape of the wrist. The attachment of these branches to one another is a function of the radius of curvature of the curve. Given that these blades are made from sheet metal, it is possible to modify the radius of curvature of the curve in one direction or in the other in order to adjust the force of attachment between these blades.

A bracelet of this type has already been proposed, particularly in EP 0865742, in which the branches of the clasp are machined in a thicker and therefore more rigid material which allows no further adjustment of the attaching force by modifying the curves of these branches. With such a clasp, as the attaching force of the branches is no longer adjustable by the abovementioned simple means, it is therefore necessary to design precise and durable attaching means. This is why this clasp includes attaching elements which are added to the cover of the clasp and positioned inside it, firstly by means of their shape, which matches a portion of the inside of the cover, and, secondly, by a rod traversing these attaching elements and fixed to their two ends in the lateral faces of the clasp cover which are arranged on either side of the clasp.

This arrangement presents various drawbacks, one of which arises from the fact that this clasp has to be a clasp with a cover, since it is this which serves to receive the attaching elements. A further drawback arises from the fact that all the force required to separate the attaching elements is supplied directly by the user, so it is impossible to exceed a certain limit, to the detriment of the security of the closure. A further drawback arises from the fact that, as in the majority of clasps of this type, opening is obtained directly by pulling on the cover, as this offers a large gripping surface, which increases the risk of unexpected opening of the clasp.

SUMMARY OF THE INVENTION

The object of the present invention is to improve the closure security of this type of clasp against unexpected opening both on account of a catching and on account of a pulling force in the wake of a blow to the wrist or of violent impacts such as those which may arise when the user applauds or when he strikes his fist on a table, for example. The object of this invention is also to facilitate opening of the bracelet while still making it possible simultaneously to increase the force necessary for separating the attaching elements. A further object of this invention is to allow the branches of the clasp and the bracelet connected to these branches to pivot through at least 180° in order to obtain maximum opening of the clasp and thus to facilitate the passage of the hand through the bracelet. A yet further object of the invention is to make it possible to have a clasp with a base which is substantially identical when the clasp includes a cover and when it does not include one.

To this end, the subject of the present invention is a bracelet clasp of the abovementioned type.

One of the advantages of the proposed solution, in addition to those ensuing from the abovementioned objects, lies in its simplicity and the small number of parts required. Indeed, despite the various improvements of the clasp according to the invention, it may be observed that these are not obtained to the detriment of the simplicity and thus of the reliability of the solution proposed. For the user, handling of such a clasp is characterized by a high level of convenience, giving him a sensation of great security, which is enhanced by the appearance of the clasp, which constitutes a veritable small precision mechanism.

BRIEF DESCRIPTION OF THE DRAWINGS

The appended drawing illustrates, diagrammatically and by way of example, an embodiment and several variant embodiments of the clasp which is the subject of the present invention.

DESCRIPTION OF THE PREFERRED EMBODIMENTS

Figure 1:
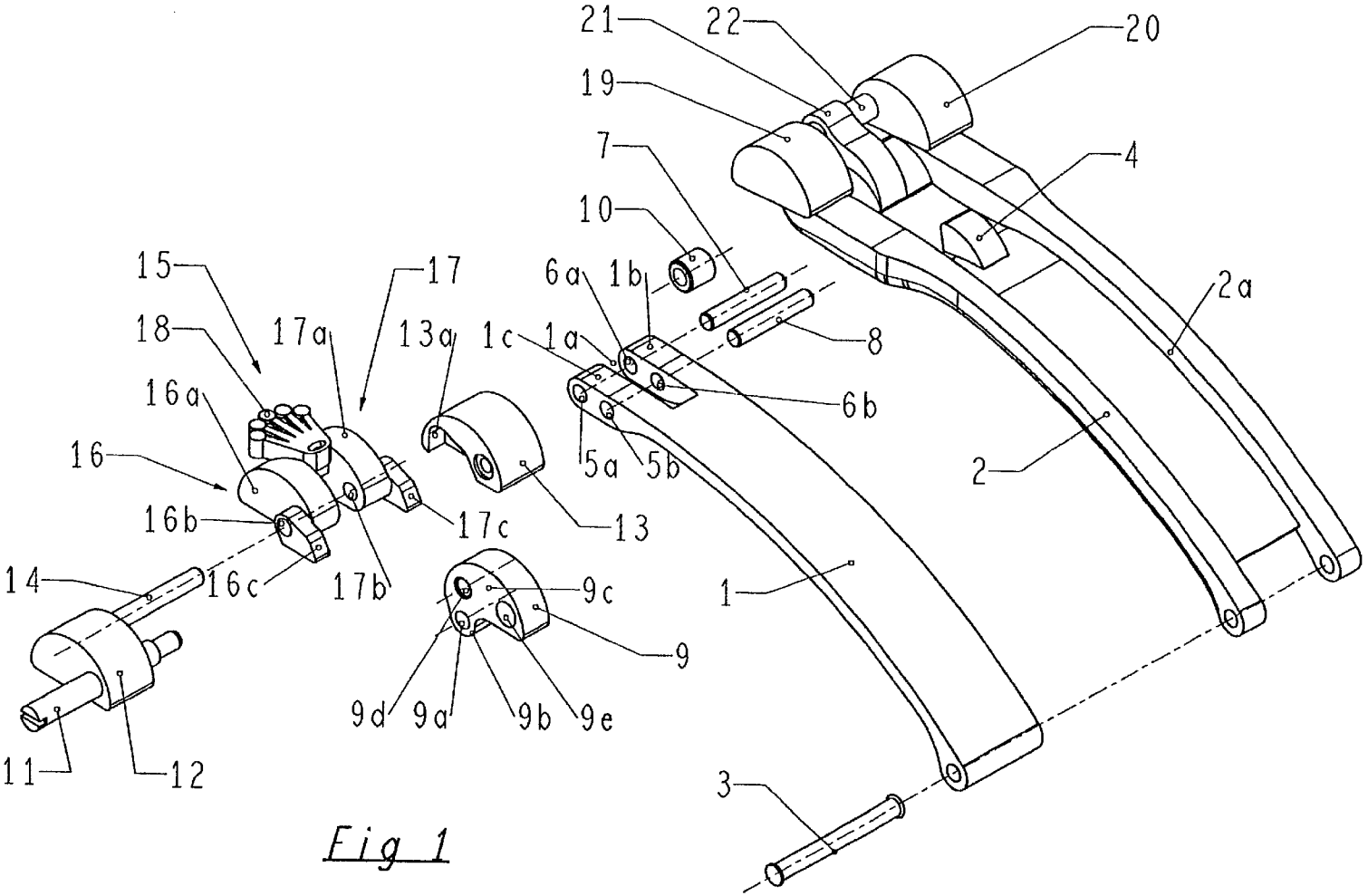
FIG. 1 is an exploded perspective view of this embodiment.
Figure 2:
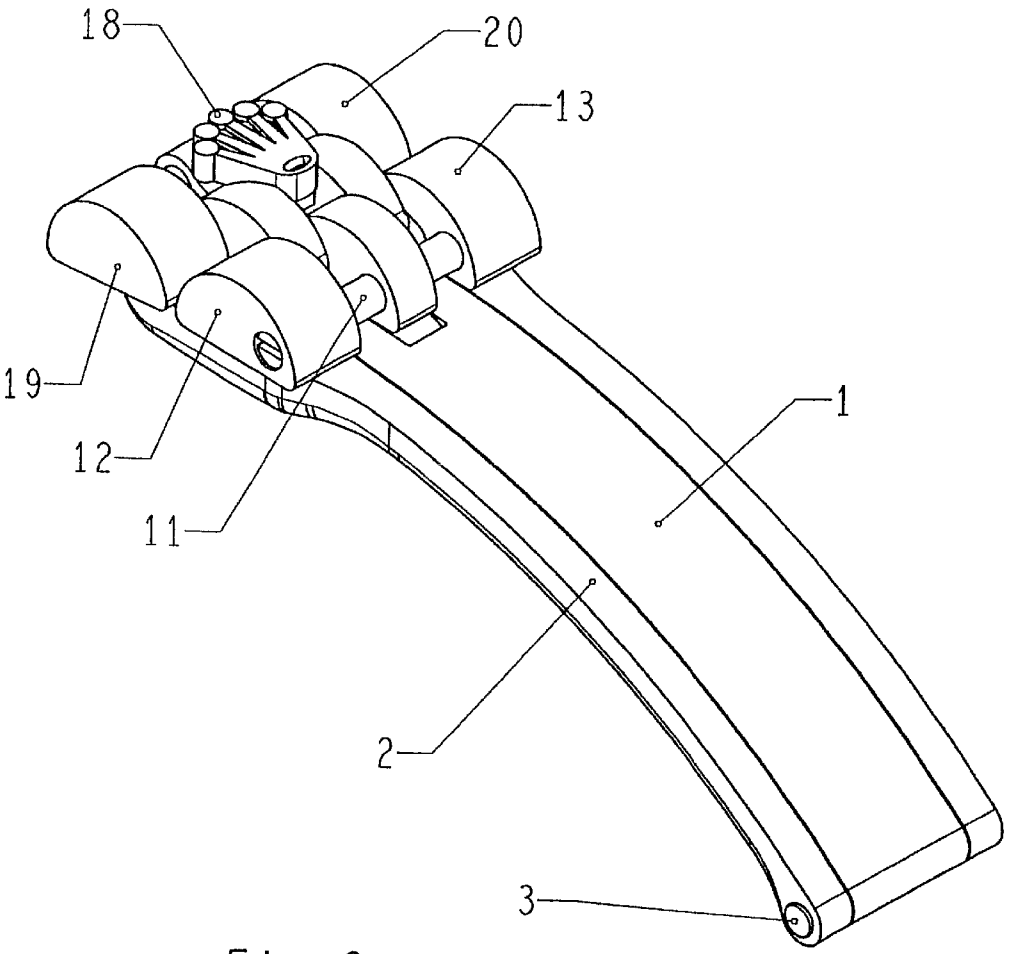
FIG. 2 is a perspective view of the clasp of FIG. 1, with the branches folded.

The clasp illustrated by FIGS. 1 to 7 includes two curved branches 1, 2 which are articulated to one another by one of their respective ends about a rod 3. These curved branches 1, 2 are preferably machined parts rather than stamped sheet metal, so that they are made relatively rigid. So that the clasp does not become over-thick, as shown in FIG. 2, the thickness of the branch 1 in the folded position is totally accommodated in a central recess 2*a* provided in the center of the branch 2.

The bottom 2*b* of the recess 2*a* has an attaching stud 4, the attaching face of which forms an angle α with the tangent to the circle centered on the articulation pin 3 of the curved branches 1, 2 and the radius of which corresponds to the distance between this pin and the point furthest from the attaching stud 4. In order to accommodate the attaching members between the curved branches 1, 2, the radius of curvature of the bottom 2*b* of the branch 2 diminishes slightly and then the curvature is reversed, thus providing a recess portion 2*a* which is slightly higher at the end of this branch 2 opposite the end articulated to the other branch 1.

Figure 5:
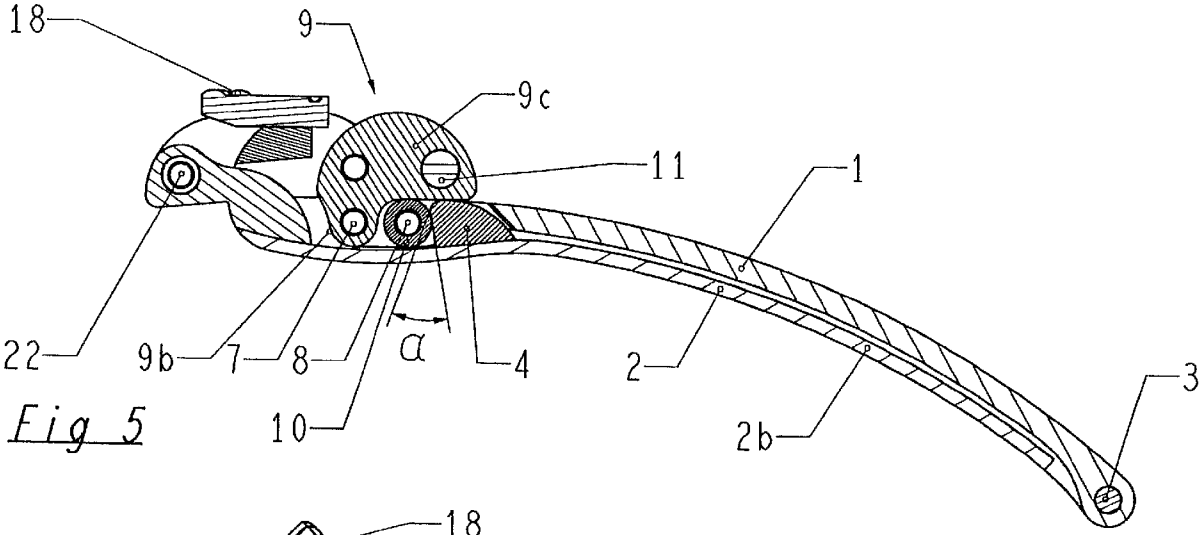
Figure 6:
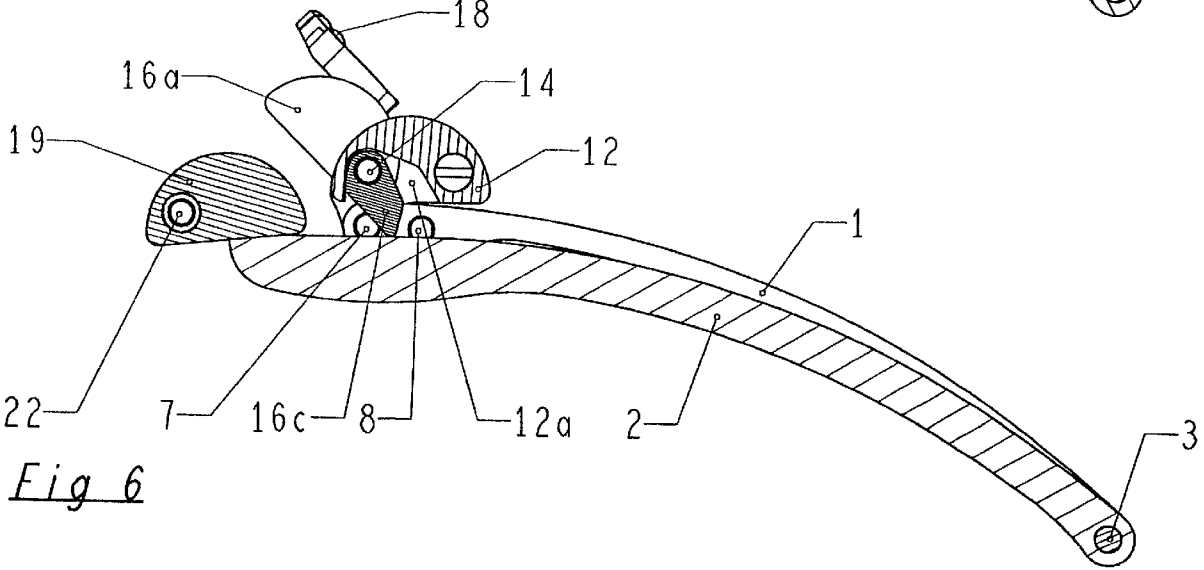
FIG. 6 is a view similar to FIG. 3, in the position in which the attaching elements are separated.

A rectangular recess 1*a* (FIG. 1) is provided at the end of the branch 1 opposite that articulated to the branch 2, forming two parallel arms 1*b*, 1*c* on either side of this recess 1*a*. Each arm includes two holes 5*a*, 5*b* and 6*a*, 6*b*, respectively, which are aligned in pairs and intended to receive pivoting rods 7, 8 set into these holes 5*a*, 6*a* and 5*b*, 6*b*, respectively. The pivoting rod 7 passes through an opening 9*a* in a linking and articulation member 9, while the pivoting rod 8 passes freely through the cylindrical opening of a tube 10, constituting the attaching element of the branch 1 of the clasp which is intended to attach against the inclined face of the attaching stud 4 of the branch 2 (FIG. 5).

The linking and articulation member 9 has a main part 9*c* of semicylindrical general shape oriented transversely to the branches 1, 2 of the clasp. The opening 9*a* for the pivoting rod 7 is provided in a semicylindrical appendix 9*b* which is off center relative to the main part 9*c*, projecting under this main part 9*c*.

The main part 9*c* of the linking member 9 is traversed by two openings 9*d*, 9*e* which are parallel to the longitudinal axis of this semicylindrical part 9*c* and to the opening 9*a* of the appendix 9*b*. The opening 9*e* is intended for the linking and the articulation of one end of the bracelet (not shown) by a spindle 11 traversing a semicylindrical assembly element 12 which is oriented transversely and aligned with the linking member 9. The spindle 11 is screwed into a second assembly element 13, which is the counterpart of the element 12.

The assembly element 12 carries an articulation rod 14 parallel to the spindle 11, set in a blind hole of this element 12, and the other end of which is intended to be fixed in a corresponding blind hole of the second assembly element 13. This articulation rod 14 passes through the opening 9*d* in the linking member 9, thus securing this linking member and the two assembly elements together.

This articulation rod 14 also passes freely through a member 15 for actuating the opening of the clasp, i.e. for separating the attaching members 4 and 10, which is articulated about the second articulation pin of the linking member 9, consisting of the axis of the opening 9*d*.

Figure 3:
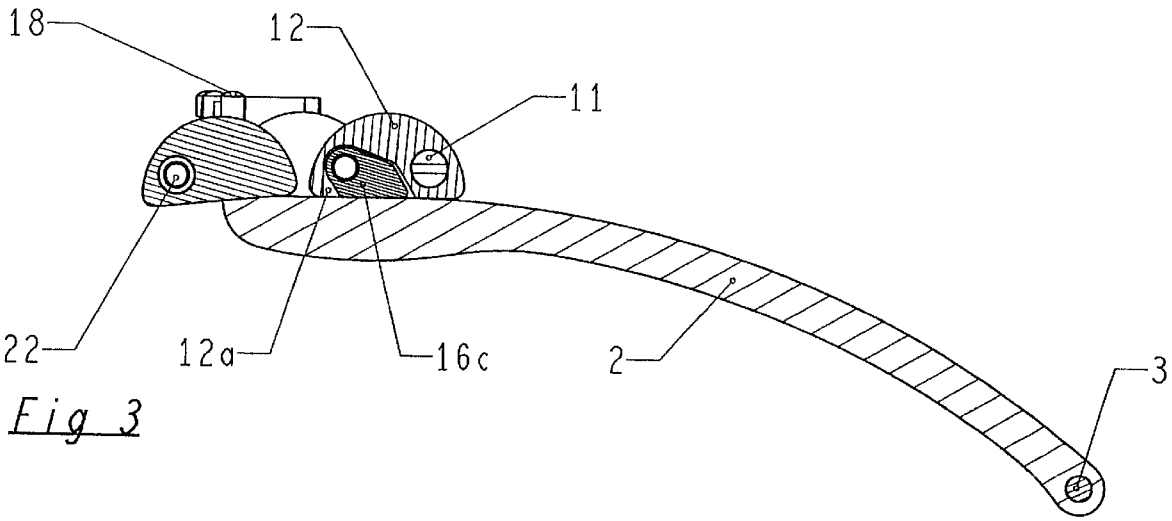
FIGS. 3, 4 and 5 are three views through three different longitudinal sections of FIG. 2.
Figure 4:
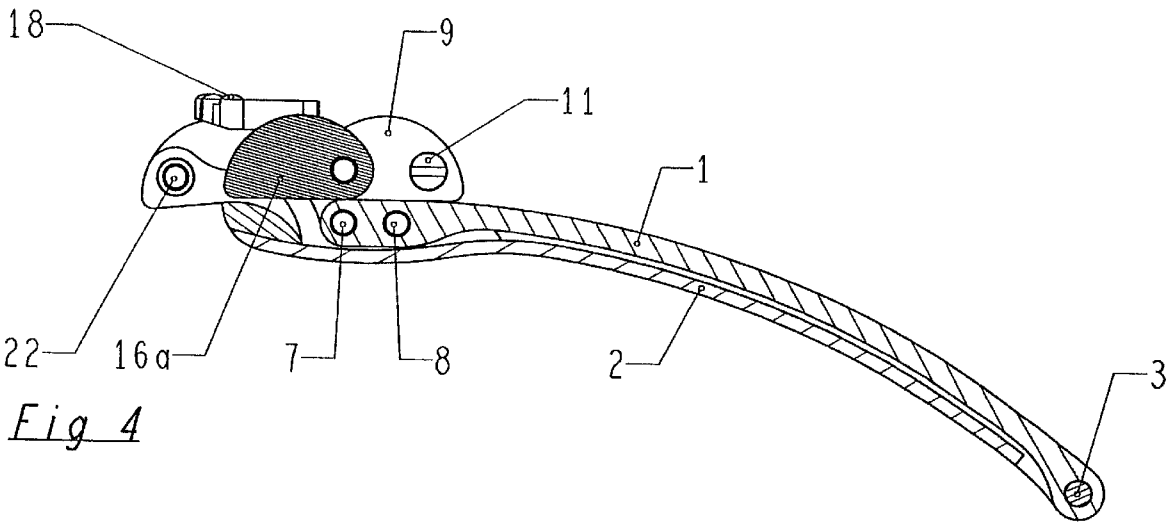

This actuating member 15 includes two opening levers 16, 17, each comprising a semicylindrical element 16*a* and 17*a*, respectively, each traversed by an opening, of which only the opening 17*b* can be seen in FIG. 1, for the passage of the articulation rod 14. The transverse distance separating the respective outer lateral faces of the two semicylindrical elements 16*a*, 17*a* is very slightly shorter than the width of the recess 2*a* of the branch 2 of the clasp, in order to allow the pivoting of these elements 16*a*, 17*a* about the articulation rod 14. These levers 16, 17 are formed from two bearing elements 16*c* and 17*c*, respectively, secured to the respective semicylindrical elements 16*a*, 17*a*. These bearing elements 16*c*, 17*c* extend outside the respective outer lateral faces of the semicylindrical elements 16*a*, 17*a* such that they bear on the upper face of the branch 2, on either side of the recess 2*a*, as illustrated in FIG. 3. These two bearing elements extend in the opposite direction from the respective semicylindrical elements 16*a*, 17*a* relative to the longitudinal axis of the articulation rod 14. Given that these bearing elements 16*c*, 17*c* extend laterally outside the semicylindrical elements 16*a*, 17*a*, the assembly elements 12, 13 include a recessed part, of which the recessed part 13*a* of the assembly element 13 can be seen in FIG. 1, while the recessed part 12*a* of the element 12 can be seen in FIG. 3.

A gripping member 18 is fixed between the two semicylindrical elements and serves for maneuvering the opening levers 16 and 17 by causing them to pivot about the articulation rod 14. The angle of pivoting of these opening levers 16 and 17 is limited by the edges of the recessed parts 12*a*, 13*a*.

The branch 2 of the clasp is secured to two elements 19, 20 in the form of a bracelet link which are aligned longitudinally with the assembly elements 12 and 13, respectively, of the same shape which are secured to the branch 1 of this clasp (FIGS. 1 and 2). A stop 21, also secured to the branch 2, is located at an equal distance from the elements 19, 20, between these elements. A spindle 22 extends between the elements 19, 20, passing through the stop 21. This spindle serves for connecting the branch 2 of the clasp to the other end of the bracelet (not shown).

As may be observed by examining FIG. 5 in particular, the engagement of the tube 10 pivoted on the rod 8 of the branch 1, on the inclined face of the angle α relative to the tangent to a circle centered on the axis of the pivoting rod 3 between the two branches 1, 2 of the clasp, is obtained by subjecting the blade 1 to a pulling force, while the blade 2 is subjected to a compression force. As the two blades are slightly curved in order to match the shape of the wrist, these forces may be reflected in an elastic deformation of these blades 1, 2, and as these blades are produced by machining in the mass and not simply from sheet metal, the force required for the attachment of the tube 10 onto the stud 4 may be relatively high, which makes it possible to guarantee satisfactory behavior in the event of impacts. Moreover, the presence of the tube 10 facilitates the elastic deformation of the blade 1 and also makes closure independent of the way in which pressure is exerted on this blade 1 during closure of the clasp.

This force required for attaching may be higher if opening of the clasp is facilitated by the mechanism of levers 16, 17 actuated by the gripping member 18, reducing the force required during lifting of the branch 1 in order to release the tube 10 from the attaching stud 4. Indeed, as may be observed in particular in FIG. 6, when the levers 16, 17 are pivoted about the articulation rod 14, raising the gripping member 18, the elements 16*c*, 17*c* of these levers bear on the upper surface of the branch 2 of the clasp, on either side of the recess 2*a* in which the branch 1 is embedded in the closed position, and form a lever arm which increases the force exerted on the rod 14 and therefore on the linking member 9 to which the end of the branch 1 is articulated.

Once the two branches 1, 2 of the clasp are separated, the semicylindrical appendix 9*b* of the linking member 9 allows the latter to turn about the attaching tube 10 such that it passes from a position in which it is to the left of the attaching tube 10 (FIG. 5) to a position in which it passes to the right of this same tube 10 (FIG. 7), allowing optimum opening of the clasp by a pivoting of at least 180° of the branch 1 relative to the branch 2 of the clasp and also a free pivoting of the links of the bracelet relative to the branches of the clasp. This is important: with this type of clasp, the ends of the bracelet are never separated from one another and it is only by an increase in the length of the bracelet following on from the pivoting of the blades 1, 2 that the hand is able to pass through the bracelet. It is therefore important that the bracelet should be able to pivot freely during opening of the branches 1, 2 and that the end links between the bracelet and the branches 1, 2 of the clasp are also free to pivot relative to these branches. This is made possible in the case of the clasp according to the invention by virtue of the linking member 9 which connects the end of the bracelet (not shown) to the branch 1 via the spindle 11 and which can itself turn freely through at least 180° about the pivoting rod 7.

Figure 7:
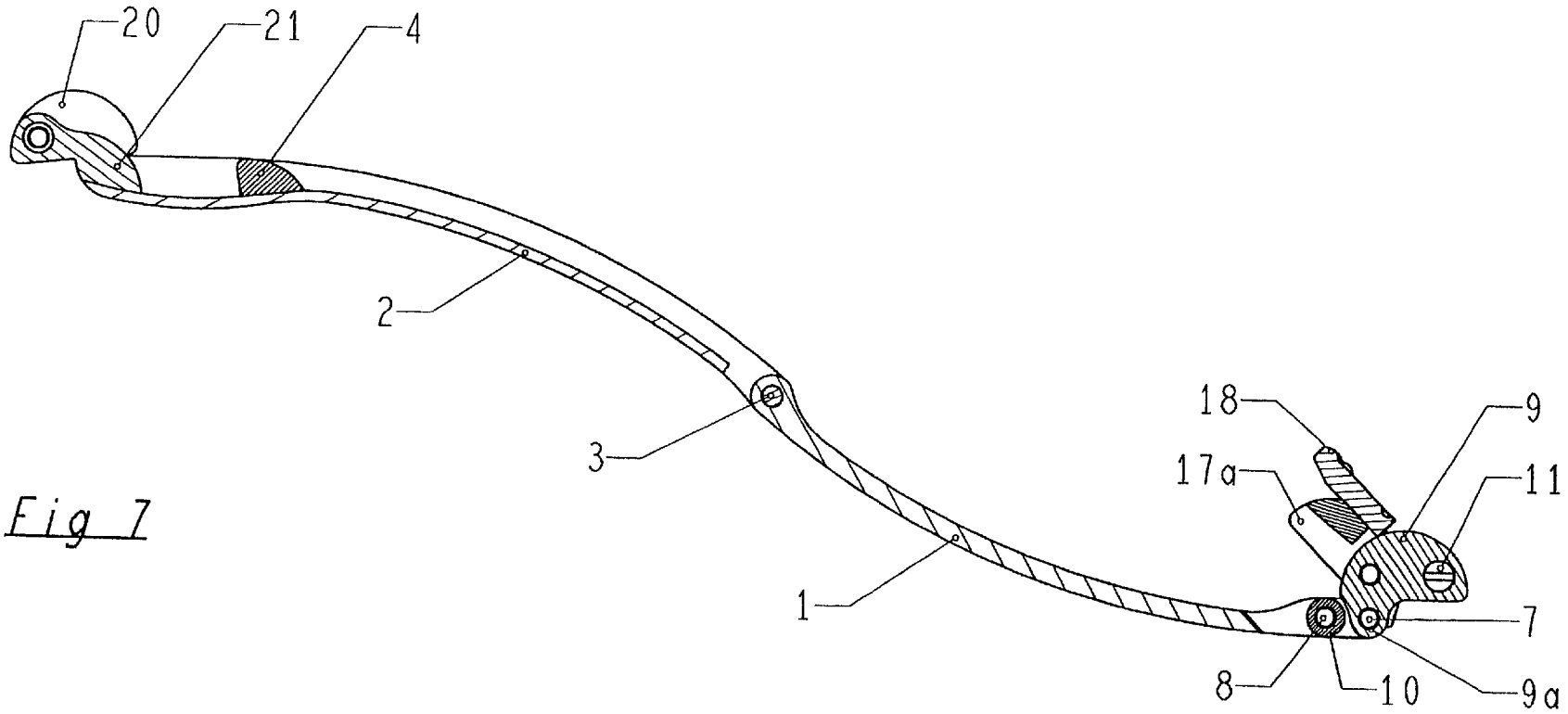
FIG. 7 is a sectional view similar to FIG. 5, in the position in which the articulated branches are unfolded.

Mention may also be made of the fact that, in the open position of the clasp, illustrated in FIG. 7, no element of the clasp's mechanism projects from its inner face, so that the user cannot injure himself by passing his hand through the open bracelet or catch parts of garments and risk spoiling them. In fact, the attaching stud 4 projects on the upper face of the branch 2 of the clasp and the cylindrical attaching tube 10 is accommodated in the thickness of the branch 1.

This linking member also allows the independent pivoting of the opening mechanism, consisting of the levers 16, 17 and the gripping member 18 of the rest of the clasp and of the bracelet, which reduces the risks of unexpected opening, particularly in the variant embodiment of the clasp with a cover, which will be described below.

The fact that the attaching tube 10 is mounted so as to pivot on the pivoting rod 8 makes it possible to reduce wear of this part as a consequence of the multiple attaching and separation operations to which it is intended to be subjected. Moreover, in the event of wear, it is easy to change this tube 10.

A further advantage of this clasp arises from the fact that the lower face of the branch 2, which is intended to abut against the wrist of the wearer, is closed and that the entire closure mechanism is located in the recess 2*a* of this branch 2 such that the risk of pinching hairs during closure of the clasp is reduced.

Figure 8:
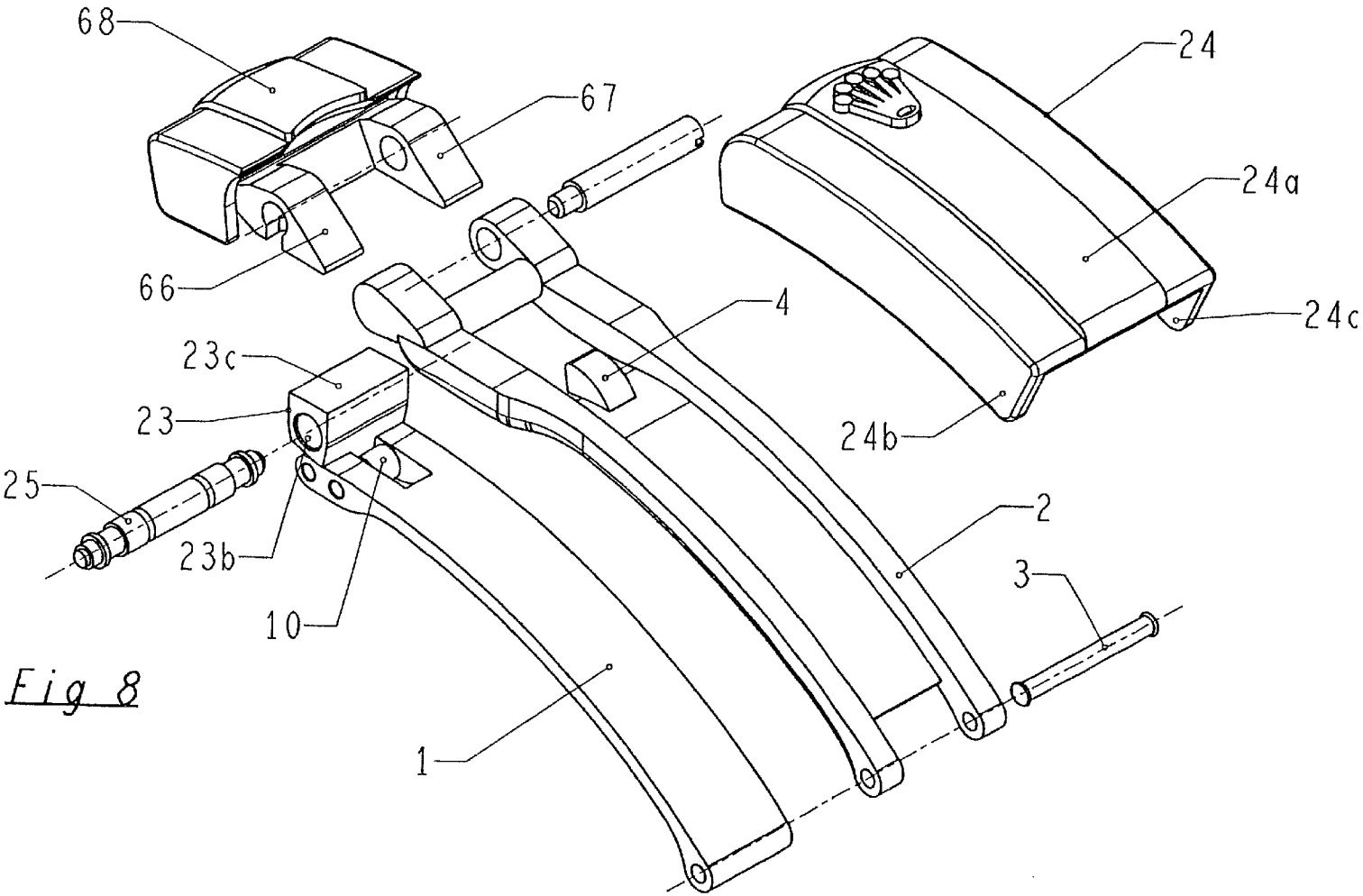
FIG. 8 is an exploded perspective view of a variant embodiment of the clasp of FIGS. 1–7.
Figure 9:
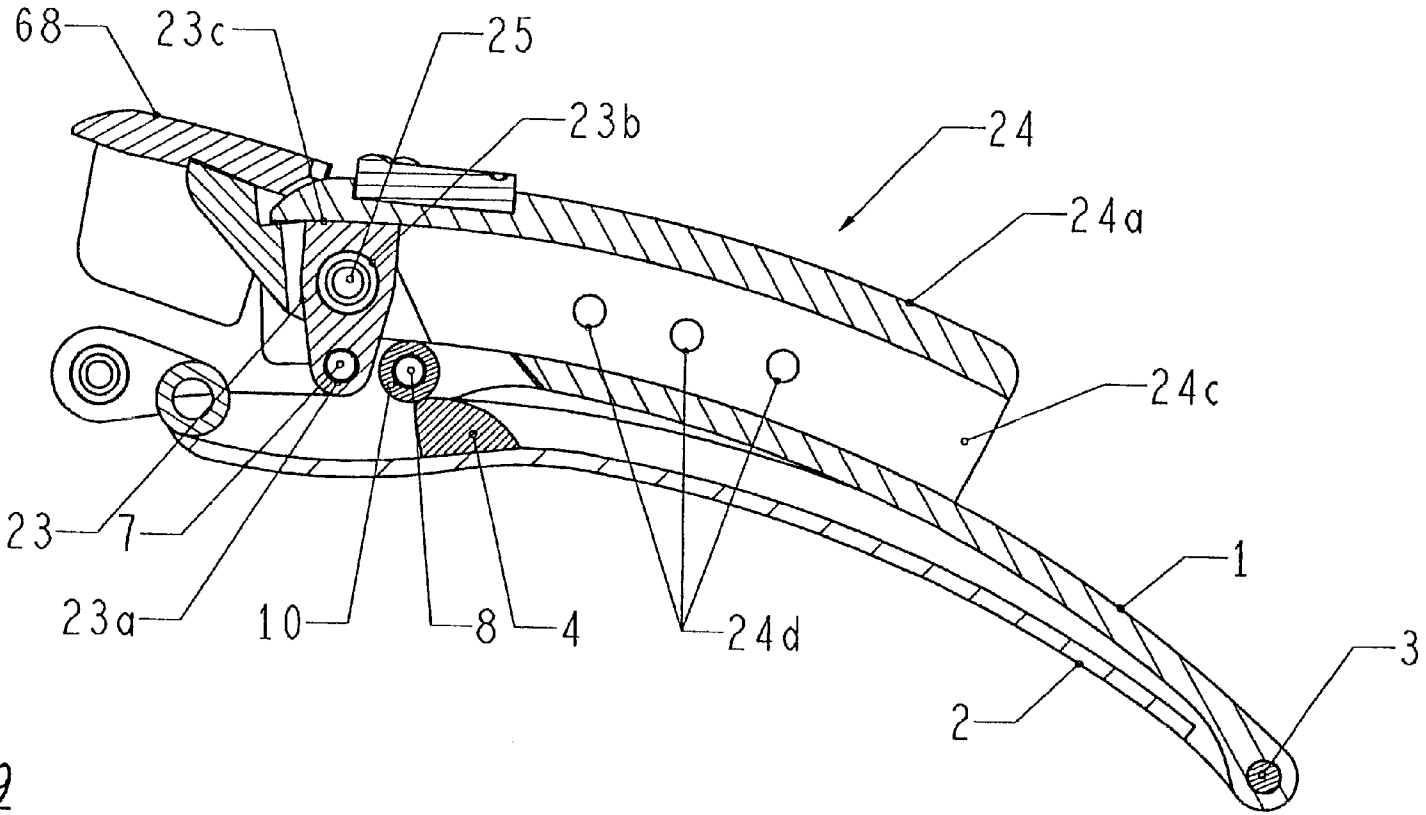
FIG. 9 is an assembled longitudinal sectional view of the clasp of FIG. 8, in the position in which the attaching elements are separated.
Figure 10:
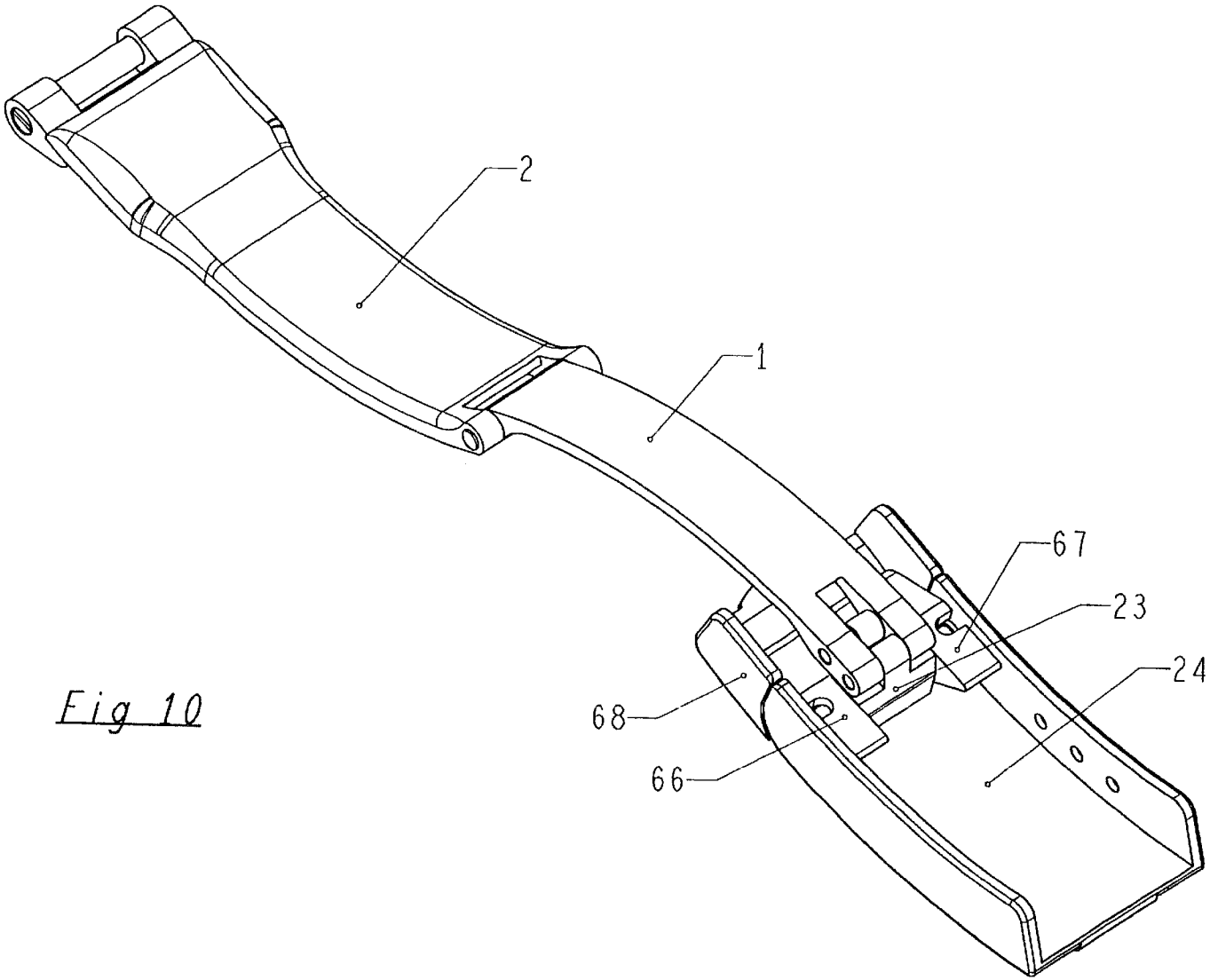
FIG. 10 is a perspective view of the variant element of FIGS. 8 and 9, in the position in which the articulated branches are unfolded.

The variant illustrated in FIGS. 8 to 10 is distinguished from the embodiment in FIGS. 1 to 7 essentially by the fact that the linking member 9 of this embodiment consists of two distinct linking elements 23 and a cover 24 comprising an upper wall 24*a* and two parallel lateral walls 24*b*, 24*c*. The linking element 23 is traversed by two parallel openings 23*a*, 23*b* (FIGS. 8 and 9), corresponding to the openings 9*a* and 9*d*, respectively, of the linking member 9. As may be seen, in particular, in FIG. 9, a spring bar 25 traverses the opening 23*b* of the linking element 23 of the linking member 23, 24, and its ends engage in blind holes (not visible) provided in the inner faces of the lateral walls 24*b*, 24*c* of the cover 24, forming the other linking element. These blind holes are similar to the blind holes 24*d* which are seen in FIG. 9 and which serve for connecting the bracelet (not shown) to the linking member 23, 24. As shown by FIG. 9, when the linking elements 23, 24 of the linking member are assembled by the bar 25, the upper face 23*c* of the linking element 23 is applied against the inner face of the upper wall of the cover 24, immobilizing these two linking elements 23, 24 relative to one another, so that the member resulting from this assembly has the same functions as the linking member 9 of the embodiment in FIGS. 1 to 7. Furthermore, the presence of the cover 24 makes it possible to adjust the length of the bracelet by virtue of the series of holes 24*d*, something the linking member 9 does not make it possible to do.

Like the articulation rod 14 of FIGS. 1 to 7, the bar 25 also allows the pivoting of the opening levers 66, 67 arranged on either side of the linking element 23 and which bear on the upper face of the branch 2 of the clasp. These levers work just like the levers 16 and 17 in FIGS. 1 to 7. In this variant embodiment, the gripping member 68 integral with the levers 66, 67 has a shape other than but a function which is identical to that of the member 18 of the preceding embodiment. The rest of the clasp is quite similar to the clasp of FIGS. 1 to 7, so there is no purpose in describing it further.

FIG. 10 shows the clasp with its branches 1 and 2 in the unfolded position, and it is possible to observe that the cover 24 and the linking element 23 can pivot integrally through at least 180° at the end of the branch 1 by turning about the attaching tube 10. In this variant embodiment, the independence between the opening mechanism 66, 67, 68 and the cover 4 offers the advantage of preventing unexpected opening of the clasp by catching the cover 24, since the latter, integral with the linking element 23, pivots about the articulation rod 7 which does not play a role in the separation of the attaching tube 10 from the attaching stud 4.

The clasps described hitherto include neither adjustment means nor security device. Indeed, various tests carried out on a series of prototypes corresponding to the clasp illustrated in FIGS. 1 to 7 have shown that it offers excellent security regarding behavior in the event of impacts and pulling forces. The design of this clasp, however, makes it possible for use to be made of means for adjusting the force required for closing it, and may also be associated with security devices.

Figure 11:
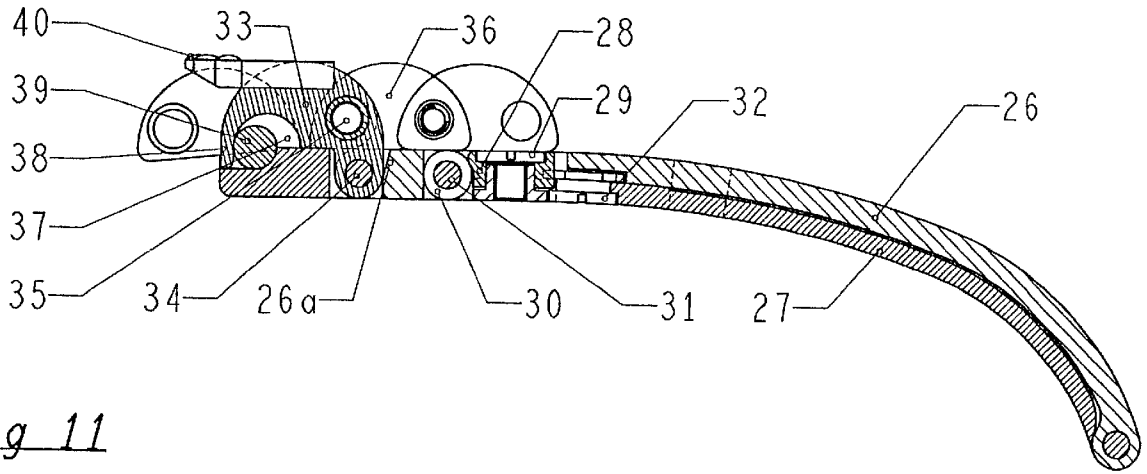
FIG. 11 is a longitudinal sectional view of a variant embodiment with supplementary security means and means for adjusting the clasp according to the invention.

FIG. 11 illustrates a variant embodiment of a clasp comprising two branches 26, 27 articulated to one another as in the preceding embodiments. The stud 4 of the lower branch is replaced in this case by a system of an adjustable stud 28 held on the branch 27 by a screw 29. This adjustable stud is intended to engage with the attaching tube 30 pivoted on a transverse pivoting rod 31 integral with the branch 26.

An adjusting member 32 which includes, at its periphery 32*a*, for example four circular recesses of the same radius as the outer surface of the adjustable stud 28, but the respective radial distance of which relative to the axis of the adjusting member 32 varies slightly relative to one another, makes it possible to adjust the penetration of this stud 28 in the trajectory of the attaching tube 30, and consequently, the force of closure of the clasp.

This also includes a security closure comprising a linking and attaching link 33 traversed by two bores with parallel transverse axes, one receiving an articulation rod 34 integral with the branch 26 and the other receiving a spindle or a bar 35 for the articulation of the first link 36 of the bracelet. This linking and attaching link 33 also includes a transverse recess 37 providing an attaching finger 38 intended for hooking over a transverse attaching cylinder 39. This linking and attaching link 33 is further secured to a gripping element 40 intended to pivot the link 33 clockwise in order to release the attaching finger 38 from the attaching cylinder 39. An inclined face 26*a* integral with the branch 26 limits the degree of pivoting of the link 33 such that, by continuing to exert a pulling force on the gripping member 40, it is possible to separate the attaching tube 30 from the stud 28 and to separate the two branches 26, 27 of the clasp.

As in the preceding embodiments, the linking link 33 with its two pivoting axes allows opening of the clasp to at least 180°, without restriction of rotation for the links 36 of the bracelet.

Figure 12:
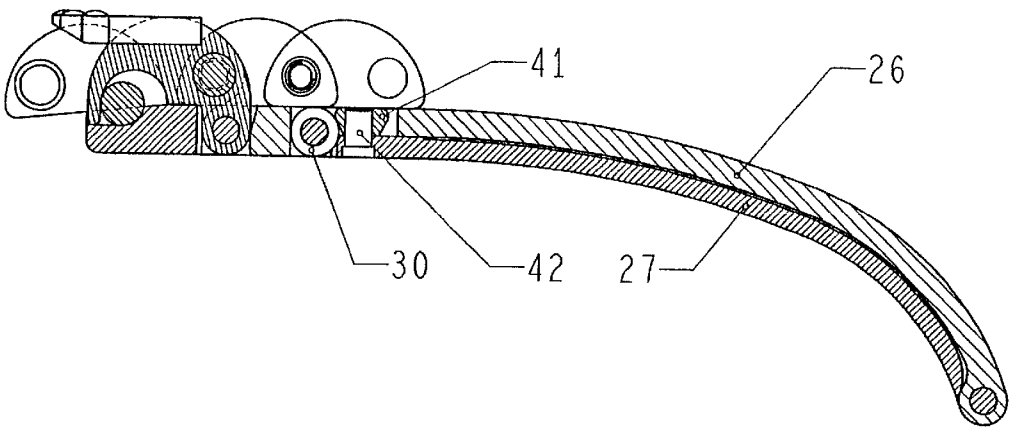
FIG. 12 is a longitudinal sectional view of a further variant embodiment of a clasp with supplementary security means and adjusting means.

The variant embodiment of FIG. 12 differs from the preceding one only in that the adjustment of the attaching stud 41 is fixed on an adjusting member 42 mounted rotatably on the branch 27, in an eccentric manner, such that, by turning the adjusting member 42, for example with the aid of a screwdriver or a similar tool, it is possible to modify the penetration of the attaching stud relative to the attaching tube 30.

Figures 13, 14, 15, 16:
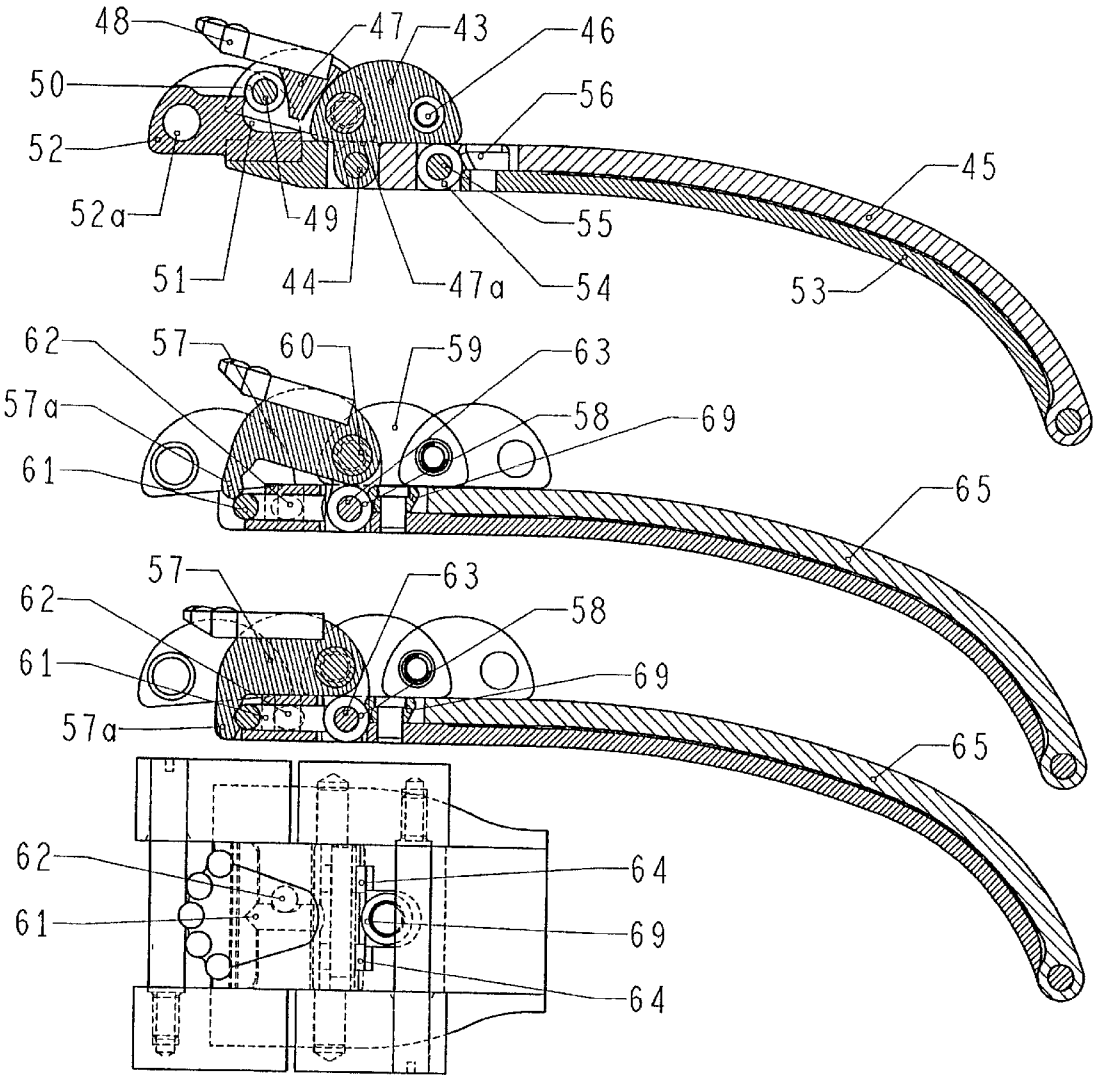
FIG. 13 is a longitudinal sectional view of yet a further variant embodiment with supplementary security means.
FIGS. 14 and 15 are longitudinal sectional views of a final variant embodiment of this clasp, in the position in which the supplementary security means are separated and attached, respectively.
FIG. 16 is a top view of FIG. 15.

The variant embodiment of FIG. 13 differs essentially from the preceding two in that there is a linking member 43 with three transverse axes of articulation, one about the pivoting rod 44 at the end of the branch 45 of the clasp, another for receiving an articulation spindle 46 of the bracelet, and the third for the articulation of an opening member 47, integral with a gripping member 48. This opening member 47 also includes a transverse rod 49 on which a tube 50 pivots, intended to be hooked in a housing 51 in an element 52 for connecting to the other end of the bracelet, and including, to this end, a bore 52*a*. This connecting element 52 is integral with the branch 53 of the clasp. As may be observed, the base of the opening member 47 has an inclined part 47*a* intended to limit its degree of pivoting. This face has exactly the same function as the inclined face 26*a* in FIG. 11.

Main closure is always provided by a tube 54 pivoted on a transverse rod 55 integral with the branch 45 of the clasp. This tube attaches on an attaching stud 56 integral with the branch 53.

The variant embodiment of FIGS. 14 to 16 differs from the preceding ones firstly in that the pivoting axis of the attaching tube 58 is combined with that of the linking and attaching link 57, while the first link 59 of one end of the bracelet is pivoted about the second articulation pin 60 of this linking and attaching link 57. The attaching element 57*a* of this linking and attaching link 57 attaches to the end of a piston 61 which is subject to an elastic return member 62. As shown in FIG. 15, when the attaching element 57*a* engages on the end of the piston 61, its other end is applied against the attaching tube 58 and prevents it from pivoting about the pivoting rod 63.

To hold this pivoting rod 63, two hinges 64 are fixed to the end of the branche 65 of the clasp (FIG. 16), on either side of the attaching stud 69 of the attaching tube 58.

What is claimed is:

1. A bracelet clasp comprising two branches articulated to one another by a respective first one of their ends in order to make it possible to fold a first one of these branches over into the second of said branches and to unfold it in order to place it substantially in the extension of this second branch, while their respective second ends are intended to be connected to two ends of a bracelet, particularly a bracelet for a wrist watch, these two branches including mutual attaching means for holding them in the folded position, wherein said second end of said first articulated branch includes linking means having parallel axes of articulation, one for connecting these linking means to this first articulated branch and at least a second one for connecting these linking means firstly to one end of the bracelet and secondly to an actuating member for exerting a force capable of separating said mutual attaching means.

2. The clasp as claimed in claim 1, wherein said linking means have third, parallel axes of articulation, one for connecting these linking means to this first articulated branch, another for connecting these linking means to one end of the bracelet, and the third for connecting these linking means to said actuating member in order to exert a force capable of separating said mutual attaching means.

3. The clasp as claimed in claim 1, wherein said actuating member includes a lever, one end of which bears on said second articulated branch and the other end of which forms a gripping means for exerting said force capable of separating said mutual attaching means.

4. The clasp as claimed in claim 1, wherein said mutual attaching means include a cylindrical element integral with one of said articulated branches.

5. The clasp as claimed in claim 4, wherein one of said attaching means consists of a tubular element pivoted freely about said cylindrical element.

6. The clasp as claimed in claim 1, wherein a part of said linking means, which is articulated to said first branch, has a substantially semicylindrical surface to allow it to turn through 180° about its axis of articulation during the passage of this first articulated branch from its folded position to its unfolded position.

7. The clasp as claimed in claim 1, characterized in that said linking means include two elements, one of which consists of a cover comprising a surface at least partially covering over said articulated branches and two lateral surfaces extending on either side of these branches and having several pairs of fixing elements aligned transversely with the clasp and spaced longitudinally, for the selective fixing of one end of the bracelet to said cover, and the other of which has means for positioning relative to said cover, assembly means serving to link said two elements in the relative position defined by said positioning means.

8. The clasp as claimed in claim 4, wherein said cylinder on which said tubular attaching element pivots is fixed removably to one of said articulated branches.

9. The clasp as claimed in claim 1, wherein adjustment means are associated with one of said mutual attaching means in order to vary the distance separating them from the other in the attaching position.

10. The clasp as claimed in claim 1, which includes second mutual attaching means for holding said actuating member in the rest position.

11. The clasp as claimed in claim 1, which includes means for limiting the pivoting of said actuating member relative to said first branch.

12. The clasp as claimed in claim 5, wherein said cylinder on which said tubular attaching element pivots is fixed removably to one of said articulated branches.

* * * * *